US005936512A

United States Patent [19]

Lohner

[11] Patent Number: 5,936,512

[45] Date of Patent: Aug. 10, 1999

[54] ROTARY POTENTIOMETER

[75] Inventor: Martin Lohner, Balingen-Engstlatt, Germany

[73] Assignee: APAG Elektronik AG, Dübendorf, Switzerland

[21] Appl. No.: 08/892,130

[22] Filed: Jul. 14, 1997

[30] Foreign Application Priority Data

Jul. 16, 1996 [DE] Germany ..... 196 29 112

[51] Int. Cl.[6] ..... H01C 10/26

[52] U.S. Cl. ..... 338/150; 338/162; 338/163; 338/152; 338/184

[58] Field of Search ..... 358/162, 163, 358/150, 152, 155, 167, 184

[56] References Cited

U.S. PATENT DOCUMENTS

| | | | |
|---|---|---|---|
| 3,124,775 | 3/1964 | Hamelberg | 338/163 |
| 3,427,680 | 2/1969 | Gilbert | 16/121 |
| 3,456,227 | 7/1969 | Paine et al. | 338/164 |
| 3,970,986 | 7/1976 | Seyler et al. | 338/171 |
| 4,206,334 | 6/1980 | LaRock | 200/291 |
| 4,306,216 | 12/1981 | Azema et al. | 338/160 |
| 5,745,025 | 4/1998 | Reuss | 338/152 |

FOREIGN PATENT DOCUMENTS

| | | |
|---|---|---|
| 864720 | 8/1952 | Germany . |
| 3800956 | 7/1989 | Germany . |
| 1267660 | 3/1972 | United Kingdom . |

*Primary Examiner*—Michael L. Gellner
*Assistant Examiner*—Karl Easthom
*Attorney, Agent, or Firm*—Paul Vincent

[57] ABSTRACT

A rotary potentiometer device (1) has a rotary potentiometer (4) disposed within a housing (2) and a handle (7) above the housing (2) for rotating a resistive disk (6) of the rotary potentiometer (4). A latching device latches the handle (7) with the upper side of the housing (2) in predetermined rotation positions. At least one spring-loaded latching nose (16) protrudes above the upper side of the housing (2) and cooperates with latching troughs (18) in the lower side of the handle (7). No additional individual components are necessary for making the latching device. The spring-loaded configuration urges the latching nose towards a latched position defined by the latching troughs when it is deflected out of its latched position.

3 Claims, 1 Drawing Sheet

ROTARY POTENTIOMETER

BACKGROUND OF THE INVENTION

The invention concerns a rotary potentiometer device having a rotary potentiometer disposed within a housing and a handle above the housing by means of which a resistive disk of the rotary potentiometer can be rotated and with a latching device for latching the handle with the upper side of the housing in predetermined rotated positions.

Rotary potentiometer devices are capable of tapping a desired resistance between a minimum value and a maximum value with the assistance of a sliding contact on a sliding contact resistive track by rotating an adjustment wheel attached to the sliding contact, wherein the minimum value and the maximum value are defined by two end stops of the sliding contact. The sliding contact resistive track can be rotated instead of the sliding contact. Conventional rotary potentiometer devices have a latching device for latching the adjustment wheel with the upper side of the housing in predetermined rotated positions to change the resistance through rotation of the adjustment wheel in a non-continuous discrete manner.

In a conventional rotary potentiometer device having such a latching device, a ball is guided in an axially displaceable fashion within a bottom hole in the upper side of the housing opening towards the lower side of the adjustment wheel and protrudes beyond the upper side of the housing towards the adjustment wheel. In this protruding position, the ball is loaded by a helical spring supported on the bottom of the bottom hole. The protruding ball cooperates with latching protrusions on the lower side of the adjustment wheel such that a particular torque is necessary when rotating the adjustment wheel to swing the adjustment wheel or the latching protrusions against the resistance of the protruding ball. In this manner, the adjustment wheel has fixed angular positions and thereby the potentiometer has defined resistor values or defined changes in the resistor values.

The conventional rotary potentiometer requires a plurality of individual components to form the latching device having the ball and helical spring which necessitate additional processing steps and which could be lost.

It is therefore the purpose of the present invention to improve a rotary potentiometer device of the above-mentioned kind in such a fashion that the latching device is particularly simple and can be made without great difficulty or expense.

SUMMARY OF THE INVENTION

This purpose is achieved in accordance with the invention in that at least one spring-loaded latching nose protrudes in the upward direction from the upper side of the housing and cooperates with latching troughs in the lower side of the handle e.g. of an adjustment wheel.

This rotary potentiometer device thereby has the substantial advantage that no additional individual components are necessary for making the latching device. The spring-loaded latching nose is provided for on the housing itself to thereby constitute the latching device together with the latching troughs of the adjustment wheel. The spring-loaded seating causes the latching noses to be urged towards a latching seat, defined by latching troughs, when displaced out of a latching seat.

In a preferred embodiment, two spring-loaded latching noses are provided for diametrically opposed to the rotation axis of the handle.

In a particularly preferred embodiment, the/each spring-loaded latching nose is formed on a spring-loaded tongue in the upper side of the housing. Such a spring-loaded housing tongue having a latching nose is particularly simple to manufacture as a one-component extruded element in a single working step.

An advantageous improvement of this embodiment provides that the/each spring-loaded tongue is formed in the upper side of the housing by means of a slot having an inner circular segment, an outer circular segment and a radial segment connecting the inner and outer circular segments.

If, in a particularly preferred embodiment, the/each latching nose has a slanted surface in both rotation directions of the handle, the mutually latched noses and troughs can each be easily freed from the latched position by rotating the handle.

Further advantages of the invention can be derived from the description and the drawing. The above-mentioned features and those to be described further below can be utilized individually or collectively in arbitrary combination in accordance with the invention. The embodiment shown and described is not to be considered an exhaustive enumeration, rather has exemplary character only for illustrating the invention.

The invention is represented in an embodiment in the drawing and will be more closely described below. The figures show an embodiment of the rotary potentiometer device in accordance with the invention in a highly schematic fashion and are not necessarily to be taken to scale.

DESCRIPTION OF THE PREFERRED EMBODIMENT

Figure 1:
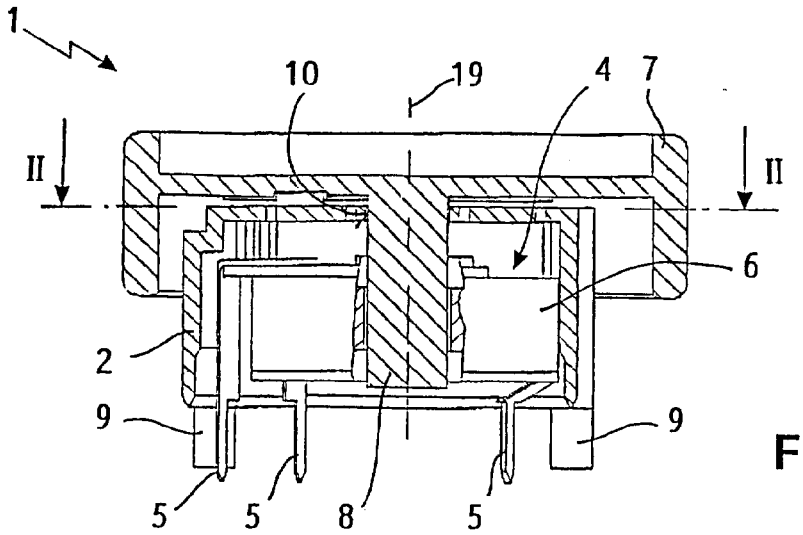
FIG. 1 shows an axial longitudinal cut through a rotary potentiometer device.

FIG. 1 shows a rotary potentiometer device 1 comprising a housing 2, an electrical potentiometer 4 disposed therein and an adjustment wheel 7 disposed above the housing 2.

The adjustment wheel 7 is connected for mutual rotation to a pivotably borne sliding contact resistive disc 6 of the potentiometer 4 with the assistance of an adjustment wheel 7 axle pin 8 engaging a hole 10 in the upper side of the housing 2. The resistance is adjusted via this sliding disc 6 and can be tapped via connection leg 5 of the potentiometer 4.

In order to be able to change the tappable resistance of the potentiometer 4 in defined resistive steps, a latching device is provided for between the upper side of the housing 2 and the lower side of the adjustment wheel 7 for adjustment of the tappable resistance in accordance with predetermined latching positions only.

Figure 2:
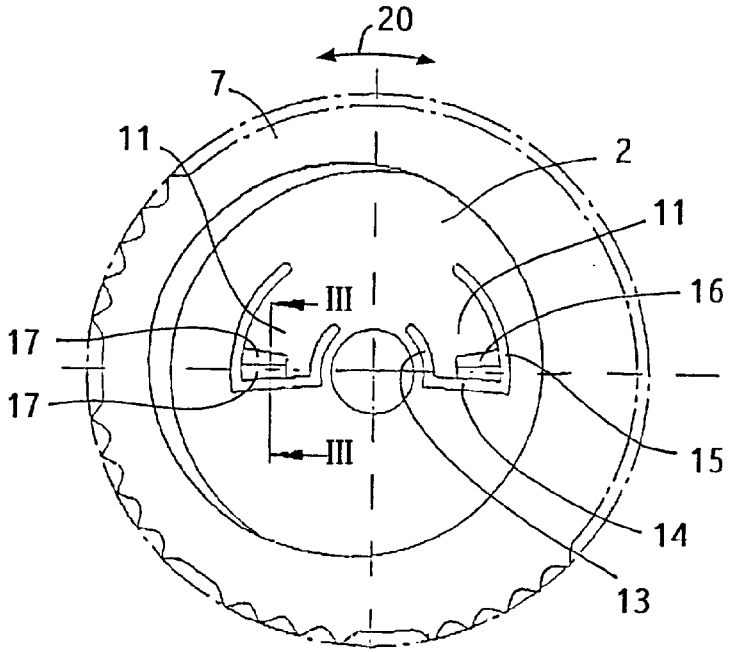
FIG. 2 shows a sectional view of the rotary potentiometer device according to II—II of FIG. 1.
Figure 3:
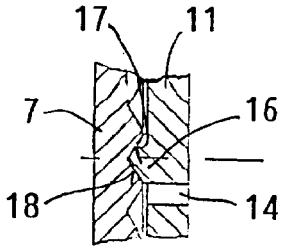
FIG. 3 shows a sectional view of the detail III—III of FIG. 2.

As shown in FIG. 2, this latching device is formed by two diametrically opposing latching noses 16 which cooperate with radial latching troughs 18 (FIG. 3) on the lower side of the adjustment wheel 7. These radial latching troughs 18 are provided for on the lower side of the adjustment wheel 7 over the entire rotation region 20 of the adjustment wheel 7, as limited by two stops 9 disposed on the housing 2.

The latching noses 16 are each disposed at free ends of spring-loaded housing tongues 11 in the upper side of the housing 2, wherein each housing tongue 11 is formed by a slot having an inner circular segment 13, an outer circular segment 15 and a radial segment 14 connecting the inner and outer circular segments of the slot. The latching noses 16 and the housing tongues 11 are thereby integral with the upper side of the housing 2. The spring-loaded tongues 11 curve about rotation axis 19 in mutually opposing directions.

The latching surfaces of the latching noses 16 cooperating with the latching troughs 18 have a roof-shaped cross-section in the rotation direction 20 comprising two slanted surfaces 17. These latching noses 16 therefore have a substantially triangular cross section in a plane parallel to a direction of rotation of the handle 7. When the adjustment wheel 7 is turned, the latching noses 16 are biased and pushed out of their latched position in the corresponding latching troughs 18 via the slanted surfaces 17 of the adjustment wheel 7 so that they latch into the next latching trough 18 by further rotating of the adjustment wheel 7.

I claim:

1. A rotary potentiometer device comprising:

a housing having an upper side and a first resilient latching nose attached to and protruding above said upper side of said housing;

a rotary potentiometer disposed within said housing, said potentiometer having a resistive disk;

a handle having a first member disposed above said upper side of said housing and having a second member passing through said upper side of said housing and into said housing, said second member connected to said resistive disk to rotate said resistive disk, said first member having latching troughs in a lower side thereof, said troughs capturing said first resilient latching nose for latching said handle to said upper side of said housing in predetermined positions; and a resilient tongue integral with said upper side of said housing, wherein said first resilient latching nose is attached to said resilient tongue, and wherein said upper side of said housing has a slot defining a periphery of said resilient tongue, said slot having an inner circular segment, an outer circular segment and a radial segment connecting said inner and said outer circular segments.

2. The rotary potentiometer device of claim 1, further comprising a second resilient latching nose integral with and protruding above said upper side of said housing disposed diametrically opposite to said first resilient latching nose relative to a rotation axis of said handle.

3. The rotary potentiometer device of claim 1, wherein said first resilient latching nose has a triangular cross-section in a plane parallel to a direction of rotation of said handle.

* * * * *